United States Patent [19]

Bowen

[11] Patent Number: 5,011,154

[45] Date of Patent: Apr. 30, 1991

[54] PUTTING PRACTICE DEVICE

[76] Inventor: Sandy W. Bowen, 228 E. 5th St., Red Springs, N.C. 28377

[21] Appl. No.: 598,837

[22] Filed: Oct. 15, 1990

[51] Int. Cl.[5] ..... A63B 69/36

[52] U.S. Cl. ..... 273/192; 273/DIG. 27

[58] Field of Search ..... 273/191 R, 191 A, 191 B, 273/192, DIG. 21, 183 A, 183 E, 186 R, 186 C; 434/252

[56] References Cited

U.S. PATENT DOCUMENTS

| | | | |
|---|---|---|---|
| 2,025,519 | 12/1935 | Lingg | 273/DIG. 21 |
| 3,604,711 | 9/1971 | Hansburg | 273/DIG. 21 |
| 3,899,180 | 8/1975 | Rotman | 273/192 X |
| 4,230,319 | 10/1980 | Lindner | 273/192 |

*Primary Examiner*—George J. Marlo

*Attorney, Agent, or Firm*—Rhodes, Coats & Bennett

[57] ABSTRACT

The present invention entails a golf teaching aid designed to assist golfers in improving their putting game. The teaching aid of the present invention comprises a frame structure having a pair of extendable and retractable putting guides formed thereon. In an extended position, the putting guide forms and elongated putting area that allows the putter to be placed therebetween and moved through a putting stroke. The presence of the putting guides assist the golfer in achieving a proper stance and also aids the golfer in developing an effective and efficient putting stroke.

13 Claims, 2 Drawing Sheets

PUTTING PRACTICE DEVICE

FIELD OF THE INVENTION

The present invention relates to golf teaching and practice aids and more particularly to a golf putting and teaching and practice aid having extensible putting guide means.

BACKGROUND OF THE INVENTION

It is well known that no part of a golfers game is more important or critical than his or her putting game. It is well known that more strokes can be lost on or around the green because of poor putting than any other place on the golf course. The art of putting is not simple because being a good putter requires technique, concentration, practice and good form. In the end, good putting depends on a variety of variables and it is important for a golfer to be able to practice putting where many of these variables can be concentrated on simultaneously. This is because that in the end it is important that all of the variables be considered and controlled during a putting exercise because if one important putting concern or variable is ignored, then the entire putting game suffers as a consequence.

There have been many devices designed to assist golfers in improving their putting game. Many of these devices have been large and cumbersome and difficult to transport and effectively used on the golf course. In addition, many of the prior art putting aid devices have not focused properly on the major putting concerns and problems of the golfer.

There has been and continues to be a need for a light weight portable golf putting teaching aid that is truly effective in identifying fundamental problems in putting and addressing these problems in a such a way that repeated use of the device efficiently improves a golfers putting game.

SUMMARY OF THE INVENTION

The present invention entails a golf putting teaching and practice aid that addresses the problems of the prior art device in as much as the golf teaching aid of the present invention is of a light weight, portable construction that can be easily carried by the golfer. In addition, the golf teaching aid of the present invention addresses the most fundamental concerns and problems of putting and encourages the golfer to concentrate on numerous considerations while the device of the present invention is being used.

In particular, the golf putting aid of the present invention includes a frame structure having a pair of extendable and retractable putting guides that extend from the frame structure and forms a parallel elongated putting area. In use, the putting guides are spaced slightly wider than the width of the putting head and the golfer is able to practice his putting stroke by moving the golf putting head through the putting area defined by the golf putting guides. In order to accommodate different width putters, at least one putting guide can be laterally adjusted with respect to the other such that the width between the putting guide can be appropriately adjusted and stationed.

It is therefore an object of the present invention to provide an efficient and effective teaching aid for teaching and improving golf putting.

Another object of the present invention resides in the provision of a golf putting teaching aid that focuses on the important considerations and techniques that are required to become an efficient putter.

Still a further object of the present invention resides in the provision of a golf putting aid that is designed to assist the golfer in establishing a proper stance over the ball and also designed to assist in putting stroke development It is also an object of the present invention to provide a golf putting teaching aid that is small, compact, portable, and which can be even carried by the golfer in his golf bag.

Another object of the present invention resides in the provision of a golf putting teaching aid that includes one or more retractable putting guides that can be moved from an extended position to a retracted position.

Another object of the present invention resides in the provision of a golf putting and teaching aid of the character referred to above wherein at least one of the putting guides can be laterally adjusted on the frame structure.

Still a further object of the present invention resides in the provision of a golf putting and teaching aid of the character referred to above wherein the putting guide means forming a part of the teaching device includes a flexible strip that is designed to assume a coiled position when in the retracted position.

Another object of the present invention resides in the provision of a golf putting teaching aid of the character referred to above wherein the device is provided with means for biasing the putting guides to a retracted coiled position.

Other objects and advantages of the present invention will become apparent and obvious from a study of the following description and the accompanying drawings which are merely illustrative of such invention.

DETAILED DESCRIPTION OF THE INVENTION

Figure 1:
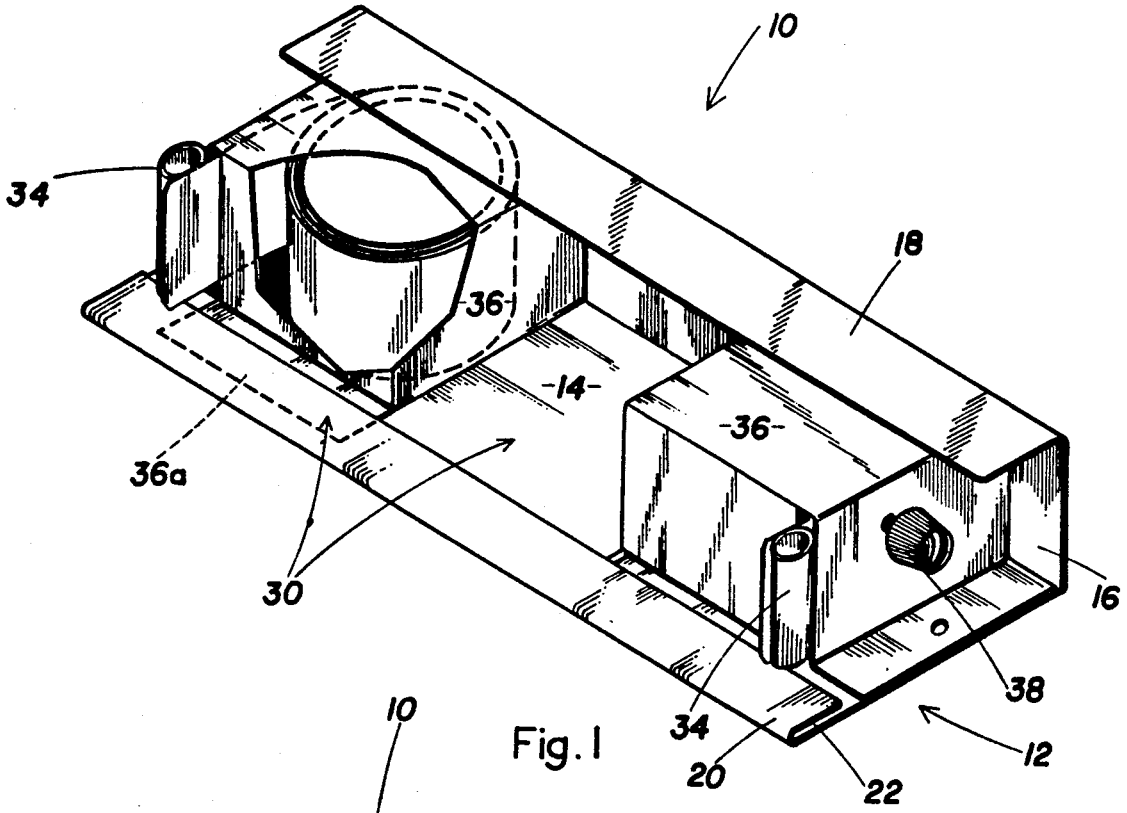
FIG. 1 is a perspective view of the golf putting teaching aid of the present invention.

With further reference to the drawings, the golf teaching aid of the present invention is shown therein and indicated generally by the numeral 10. Golf teaching aid 10 can be constructed of metal, plastic or any other suitable material.

Viewing the golf teaching and practice aid 10 in more detail, it is seen that the frame structure includes a basic frame structure indicated generally by the numeral 12. Forming a part of the frame structure 12 is an L-shaped structure that includes a bottom 14, a back 16 and an upper flange 18. Formed along the front edge of the bottom 14 is a slide lip 20 that is bent or curled to form an opening 22.

Figure 4:
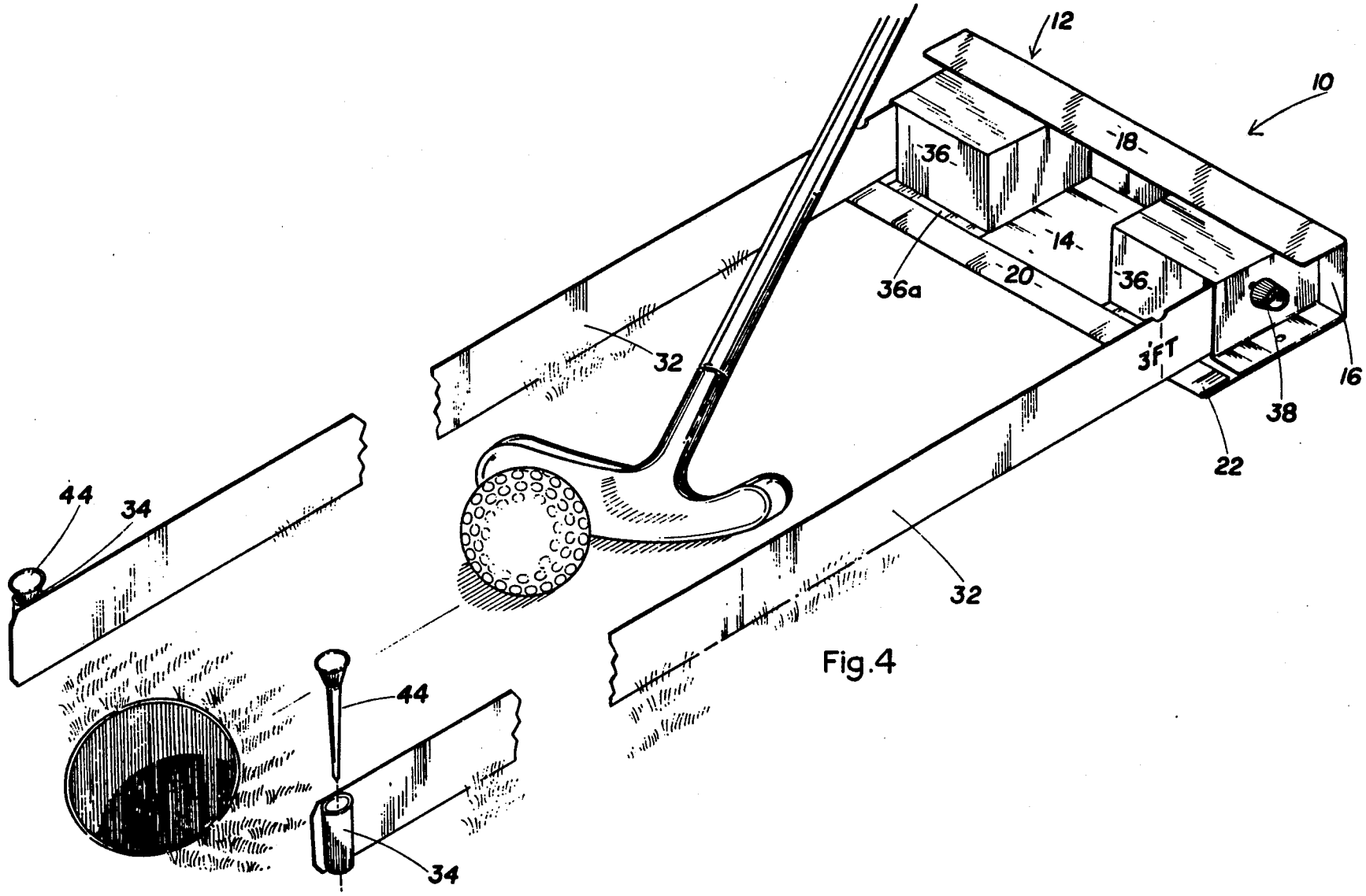
FIG. 4 is a perspective view of the golf teaching aid of the present invention showing the putting guides in an extended position and illustrating the use of the present invention.

Mounted on frame structure 12 is a pair of retractable guide assemblies indicated generally by the numeral 30. Each guide assembly includes a guide or flexible strip 32 that is moveable from a retracted position (FIG. 1) to an extended (FIG. 4). In the retracted position, the guide or strip 32 assumes a coiled position, and as such, substantially the entirety of the guide 32 is housed within the block housing 36. Details of the retracting mechanism is not shown in detail as the structure and operation of the such is commonly understood and appreciated by those skilled in the art. However, each guide assembly 30 in a preferred embodiment would assume a basic design character similar to a conventional retractable measuring tape such as those manufactured by hand tool companies. Also it is appreciated that the flexible guide or strip 32 can be connected to a torsion spring through a sleeve and wherein the torsion spring is set to automatically retract and coil the guide or strip 32 either directly or through a connecting sleeve. In any event, the basic structure and design of a retractable measuring tape is well known and appreciated in the art, and that structure and design can be utilized to house and actuate the guides or strips 32.

In addition, the present invention contemplates another design wherein the guide or strip 32 would be of a flexible nature and would be designed and constructed such that it would automatically tend to assume a coiled position. In such a case, one end of the guide or strip 32 can be anchored to the main frame structure 12 while the guide or strip is preconditioned, through memory, to automatically assume a coiled position. The strip or guide can be extended by simply uncoiling the same.

As seen in the drawings, the housing structure 36 is of a basic box configuration and is designed to house the flexible guides or strips 32 when retracted. As will be discussed subsequently, one of the housings 36 is designed such that it can be adjusted laterally back and forth so as to adjust the width between the strips 32 when they are in an extended position. In order to retain the guides 32 in an extended position such as suggested in FIG. 4, there is provided a stop screw 38 threaded into a side wall of each housing 36. As seen in the drawing stop screw 38 can be screwed into an engaged position with a respective guide or strip 32 so as to station and anchor that strip or guide 32 in an extended position.

Figure 2:
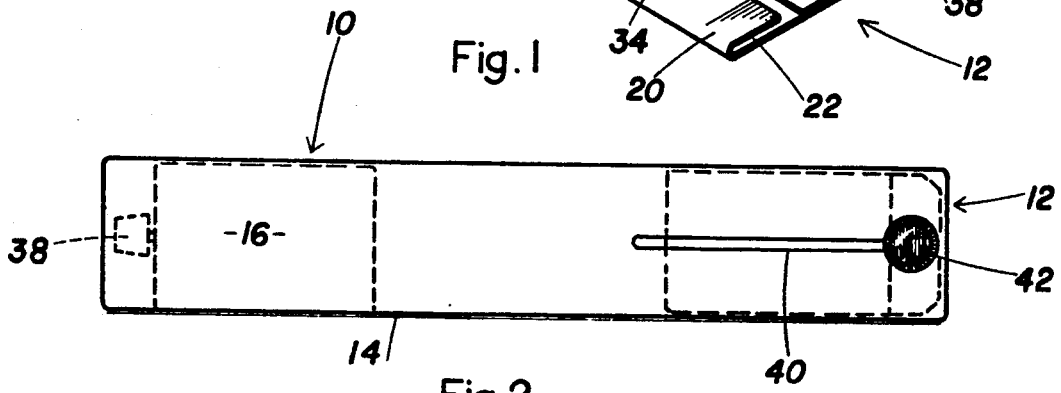
FIG. 2 is a back elevational view of the golf teaching aid of the present invention.
Figure 3:
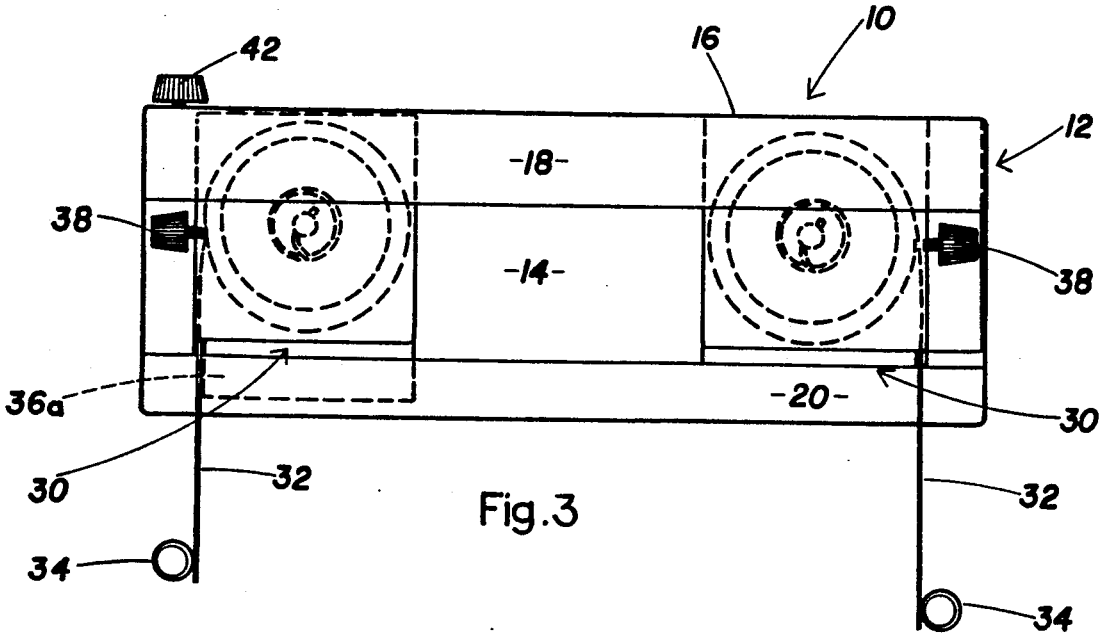
FIG. 3 is a top plan view of the golf teaching aid of the present invention.

As mentioned above, at least one housing 36 is designed such that it can be moved and adjusted laterally back and forth so as to vary the width between the respective strips 32 when extended. In order to accommodate this feature, there is provided an elongated slot indicated by the numeral 40 (FIG. 2) which is formed in the back wall 16 of the frame structure 12. A slide screw extends through the slot 40 and is secured to the housing 36, which happens to be the left most housing as viewed in FIG.1. Thus, is it appreciated that by loosening slide screw 42, one can laterally shift or move in the associated housing 36 back and forth. It is seen in FIG. 1 that the left most housing 36 includes a slide plate 36*a* that projects into opening 22 formed by the slide lip 20. Also it is appreciated from the drawings that the left most housing 36 shown in FIG. 1 is also confined by the flange 18. Therefore, it is appreciated that as the left most housing 36 as viewed in FIG. 1 is moved back and forth that the same is confined within the frame structure 12 by the slide plate 36*a* projecting into opening 22 and the flange 18 which extends over a portion of the housing itself.

Fixed to the remote or extended end of each guide or strip 32 is an anchoring sleeve 34. Anchoring sleeve 34 is designed to receive a golf tee or pin 44. Essentially the golf tee or pin 44 can be inserted through the anchoring sleeve 34 so as the station a respective guide strip 32 in an extended position. Golf tee or pin 44 would extend into the underlying carpet or ground, whichever forms the surface being utilized.

In use, it is appreciated that the golf teaching aid 10 of the present invention is small, compact and can be carried from one location or another with relative ease. In addition, the device can be used on a carpet or on an actual putting green or the like.

To utilize the golf teaching aid of the present invention, the flexible guides or strips 32 are extended and anchored into position such as shown in FIG. 4. there the guides 32 form two parallel boundaries or strips. Thereafter, the player can position a golf ball and a putting head between the guides or strips 32 and practice his or her putting stroke. Thus, as the golfer swings the putter head through a putting stroke, he or she is able to determine if the putter head is being held perpendicular to the desired line of travel or contact. In addition, the extended guide strips assist the golfer in developing a smooth and straight putting stroke. Beyond that, the presence of the guides or strips 32 enable the golfer to develop a proper stance over the ball such that the golfer's body and particularly his or her feet can be appropriately positioned with respect to the ball.

From the foregoing specificaiton and discussion, it is appreciated that the present invention presents and new and unique golf teaching aid that is particularly designed to improve and help develop a golfers putting game.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. A golf putting teaching and practice aid comprising:

(a) a frame structure;

(b) a pair of extendable and retractable putting guides mounted on the frame structure, each putting guide being moveable between an extended position and a retracted position and each putting guide including an elongated strip that assumes a coiled position when in the retracted position;

(c) wherein the extended position the putting guides form a pair of parallel retainers that defines an elongated putting area there between; and (d) means for laterally adjusting at least one of the putting guides on the frame structure such that the width of the putting area can be varied to accommodate various putter head widths.

2. The golf putting teaching and practice aid of claim 1 wherein there is provided a housing structure for housing the putting guides when they assume the retracted position.

3. The golf putting teaching and practice aid of claim 2 wherein the housing structure includes a pair of housing compartments with each housing compartment enclosing a respective putting guide when the same is in the retracted position.

4. The golf putting teaching and practice aid of claim 3 wherein each putting guide includes means for biasing the flexible strip to a coiled retracted position within the housing compartment of that respective flexible strip.

5. The golf putting and teaching aid of claim 4 wherein there is provided retaining means formed in each housing compartment for selectively engaging the flexible strip and holding the same in an extended position.

6. The golf putting teaching and practice aid of claim 3 wherein the means for laterally adjusting at least one putting guide includes a means for mounting at least one compartment housing for back and forth movement within the frame structure, and wherein there is provided means for selectively securing the moveable compartment housing at a selected position with respect to the frame structure.

7. The golf putting practice and teaching aid of claim 6 wherein the frame structure is shaped to form a guide and wherein the moveable compartment housing is movably mounted within said guide and moveable back and forth therein.

8. The golf putting teaching and practice aid of claim 7 wherein the frame structure includes an L-shaped member having a slide lip and a retaining flange, and wherein the moveable compartment housing is confined within the retaining flange and includes a slide extension that extends into and moves underneath the slide lip.

9. The golf putting teaching and practice aid of claim 8 wherein there is provided an elongated slot in the L-shaped frame structure and wherein there is provided a housing retainer secured to the housing and extending through the slotted L-shaped frame structure for stationing the moveable compartment housing in a selection position.

10. The golf putting teaching and practice aid of claim 1 including means for anchoring and stationing the putting guides in an underlying surface when disposed in the extended position.

11. The golf putting teaching and practice aid of claim 10 wherein the means for anchoring and stationing the putting guides include a penetrating member secured to the putting guide and extending therefrom for an engagement with the ground or other underlying surface.

12. The golf putting practice and teaching aid of claim 1 including retaining means for selectively engaging the putting guide and maintaining them in the extended position.

13. The golf putting and teaching aid of claim 1 wherein the putting guides include means for biasing each flexible strip towards a coiled retracted position.

* * * * *